United States Patent [19]

Jantzen

[11] Patent Number: 4,616,891

[45] Date of Patent: Oct. 14, 1986

[54] STORAGE CABINET WITH MULTIPLE STORAGE COMPARTMENTS

[76] Inventor: Eric Jantzen, 39 bis, rue Greneta, 75002 Paris, France

[21] Appl. No.: 621,470

[22] Filed: Jun. 18, 1984

[30] Foreign Application Priority Data

Jun. 20, 1983 [FR] France ..... 83 10167

[51] Int. Cl.[4] ..... A47B 88/02

[52] U.S. Cl. ..... 312/328; 312/216; 312/276; 312/327

[58] Field of Search ..... 312/326, 327, 348, 276, 312/275, 282, 328, 329

[56] References Cited

U.S. PATENT DOCUMENTS

| | | | |
|---|---|---|---|
| 1,883,776 | 10/1932 | Forsyth . | |
| 2,523,762 | 9/1950 | Howard | 312/327 |
| 2,655,423 | 10/1953 | Strayer | 312/348 |
| 3,331,644 | 7/1967 | Kafferlin | 312/216 |
| 4,047,615 | 9/1977 | Browne . | |
| 4,064,992 | 12/1977 | Ralston et al. . | |

FOREIGN PATENT DOCUMENTS

| | | | |
|---|---|---|---|
| 728993 | 1/1969 | Belgium . | |
| 10755 | 4/1908 | Denmark | 312/328 |
| 1117777 | 12/1954 | France . | |
| 413100 | 7/1934 | United Kingdom . | |

*Primary Examiner*—Francis K. Zugel
*Assistant Examiner*—Joseph Falk
*Attorney, Agent, or Firm*—Karen M. Gerken; Martin P. Hoffman

[57] ABSTRACT

The storage cabinet comprises a plurality of superposed storage compartments pivoting about horizontal axes to pass from an open position to a closed position, and vice-versa.

Each compartment is in the shape of a trough with a bottom part constituted by a portion of cylinder and two lateral end walls.

Each trough is provided at its rear part with a tongue piece which extends inwardly substantially perpendicularly to the bottom wall of the trough and ensures, in the trough closed position, a continuity with the bottom wall of the lower adjacent trough, so that in the closed position, each trough is entirely closed.

14 Claims, 12 Drawing Figures

STORAGE CABINET WITH MULTIPLE STORAGE COMPARTMENTS

Figure 1:
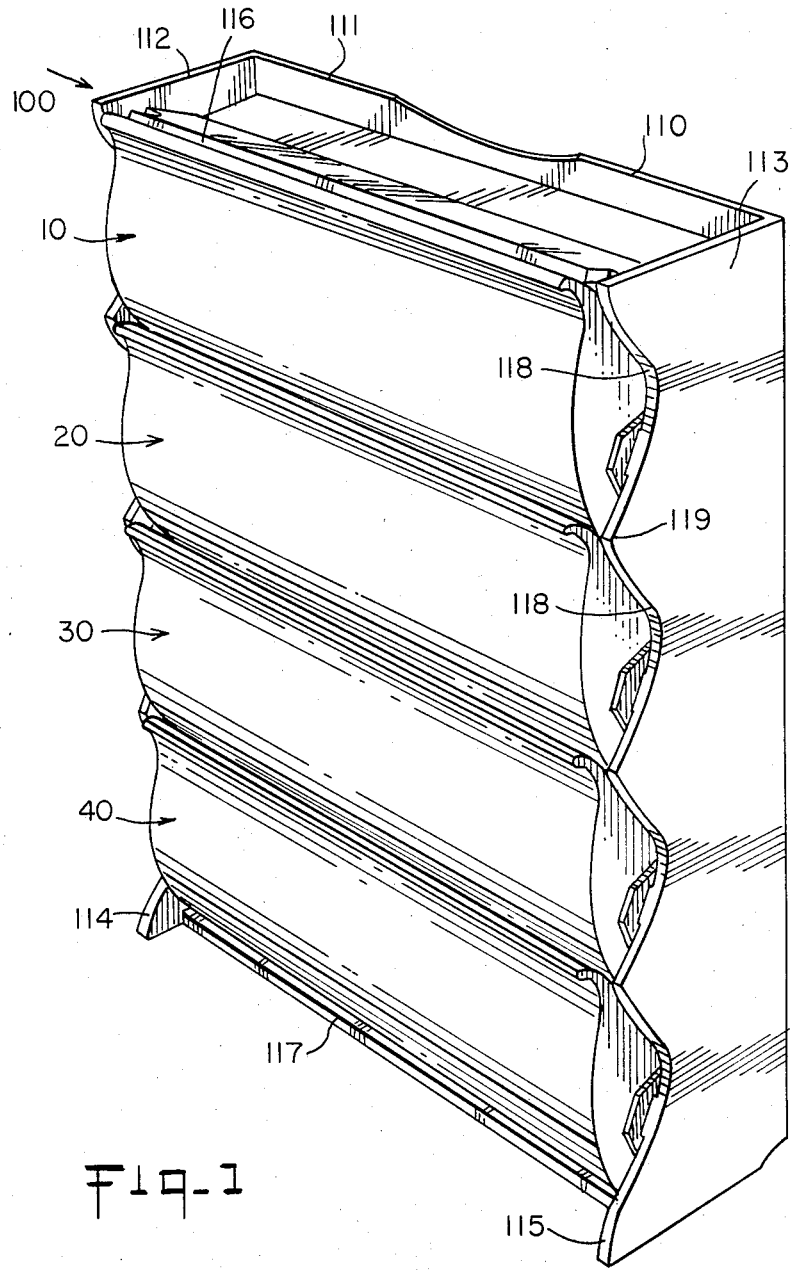

The present invention relates to a storage cabinet with multiple storage compartments, of the type comprising a support frame in which are mounted a plurality of aligned storing compartments, each of which is adapted to come in a first closed position and a second open position, said storage compartments being distributed in at least two superposed rows and being in the form of troughs pivotable about parallel horizontal axes mounted in the support frame, each trough having a bottom wall which is constituted by a portion of cylinder and two lateral end walls.

Different storage cabinets or units are already known which are composed of a set of compartments designed to contain loose objects of different types such as tools, spare parts or the like. Due to the plurality of compartments, it is possible to store the objects according to their type, each compartment containing only objects of a same type.

To make a quick selection amongst different objects placed in different compartments, for example amongst different parts of the same type but stored in different compartments, depending on whether they are stored according to size or to shape, it may be lengthy and fastidious to search successively in the different compartments which are in general produced in drawers or like installations. Also, the storage cabinet equipped with drawers are not always sufficiently compact or do not give ready access to the objects stored in the drawers. In particular, when two superposed adjacent drawers are opened simultaneously, it is not possible to have access to the bottom drawer because the base of the top drawer covers up the open part of the bottom drawer. Therefore it may often take a relatively long time to locate a part or an object through a multiplicity of compartments in the conventional storage cabinets or units.

Other storing cabinets such as described in U.S. Pat. No. 1,883,776, are composed of a set of superposed storage compartments which are constituted by shell members pivotable about parallel horizontal axes, the opening and closure of these shells being simultaneously controlled by a system of bars. Such a type of storage cabinet however, has proved to be not very fonctional because the storing volume and the shells opening angle are limited. Besides, the cabinet is relatively high and the objects placed inside the shell can easily drop out through the back when the shells are closed.

It is the object of the present invention to overcome the aforesaid disadvantages by proposing a storage cabinet with multiple storage compartments which is compact as well as easy to produce and practical to use, with readily accessible storage compartments, owing to a virtually instantaneous passage from the closed position to the open position of the compartments, and giving a large storage volume inside containers which are perfectly closed in the closed position and offer excellent accessibility in the open position.

These objects are reached with a storage cabinet of the type with multiple compartments such as defined hereinabove, and in which according to the invention, each trough is equipped at its rear part with a tongue piece which extends outwardly substantially perpendicular to the bottom wall of the trough, said tongue piece being inside a horizontal plane when the trough is in open position and ensuring when the trough is in closed position, a continuity with the bottom wall of the lower adjacent trough, so that when in closed position, the trough is entirely closed.

Storage compartments, if produced in the form of pivotable troughs, are more readily opened or closed than slidable drawers, and moreover they offer greater facility of access to the stored objects even when all the compartments are open. According to one advantageous embodiment, opening and closing of all the compartments can also be simultaneous, this further increasing ready selection of the objects stored in the cabinet, which is automatically converted into a display unit when in the open position.

And more particularly, according to the invention, each trough pivoting about a horizontal axis has a bottom wall constituted by a cylinder portion, and two lateral end walls, and the bottom wall, as seen in cross-section inside a plane perpendicular to the trough pivoting axis, has a first rear part of radius progressively increasing from the free rear end of the bottom wall with respect to a center of curvature, a second main part, of substantially constant radius with respect to said center of curvature, and a third front part which is substantially rectilinear, said first, second and third parts being joined one to the other in succession and without discontinuity.

According to a special embodiment of the invention, said first rear part comprises, starting from the free rear end of the bottom wall, a first portion which is substantially rectilinear and small in length, and a second curved portion of radius substantially constant with respect to a second center of curvature situated above the trough pivoting center inside a vertical axial plane.

The first part has an angular opening of between 50° and 80° and the second part has an angular opening of between 140° and 160°.

The bottom wall part of smaller radius has a minimum radius of about 75 to 85% of the radius $R_2$ of the second main part, and the third substantially rectilinear part has a length which is about 100% to 140% of the radius $R_2$ of the second main part.

In the trough closed position, the joining up area between the third and second parts is substantially situated inside a horizontal plane traversing the trough pivoting axis.

Also in the trough closed position, the third part is inclined inwardly of the trough, forming with the vertical an angle varying between 4° and 8° and preferably closer to 5°.

In the trough closed position, the free end of the first part of the bottom wall is situated inside a plane forming an angle of between about 25° and 35° with respect to the horizontal plane which traverses the axes containing the second centers of curvature.

The distance between the axes of two superposed troughs is substantially equal to twice the radius of the second part of the bottom wall of a trough.

The free end of said third part may be equipped with a grasping lever or with a grasping edge, bent outwardly.

The inside wall of the trough bottom is rigid and smooth.

Clipping in means are provided in the inside wall of the trough bottom, close to the vertical planes, to receive removable vertical separations parallel to the lateral end faces of the troughs.

According to one advantageous embodiment, the locking means of a trough consist in at least one boss formed on bar integral with a lug piece which is fast with the rear part of the trough bottom wall, and in at least two spaced apart bosses situated along the path of the bosse of the bar when the trough passes from the closed position to the open position.

All the different aligned and superimposed troughs may be joined to one and the same bar, thus permitting simultaneous closure and opening of all the troughs.

Figure 2:
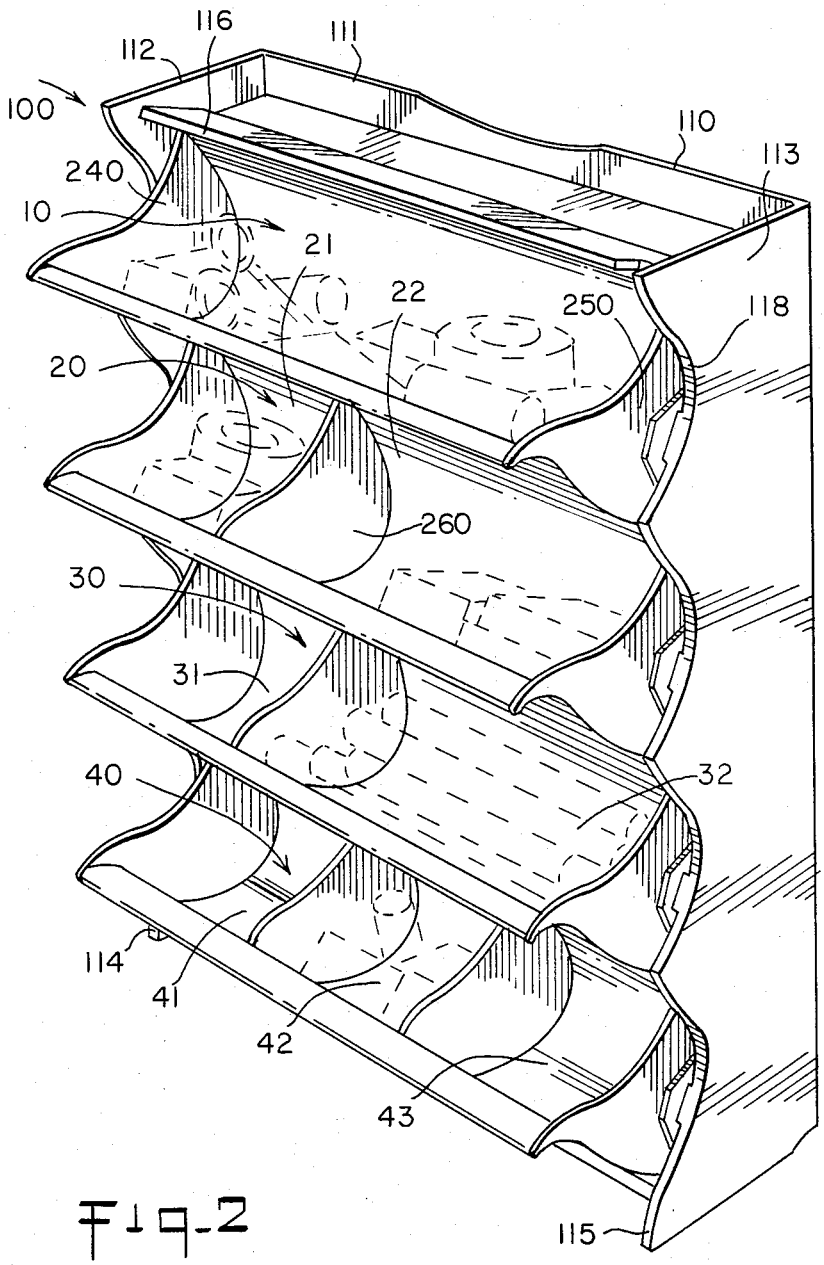
Figure 4:
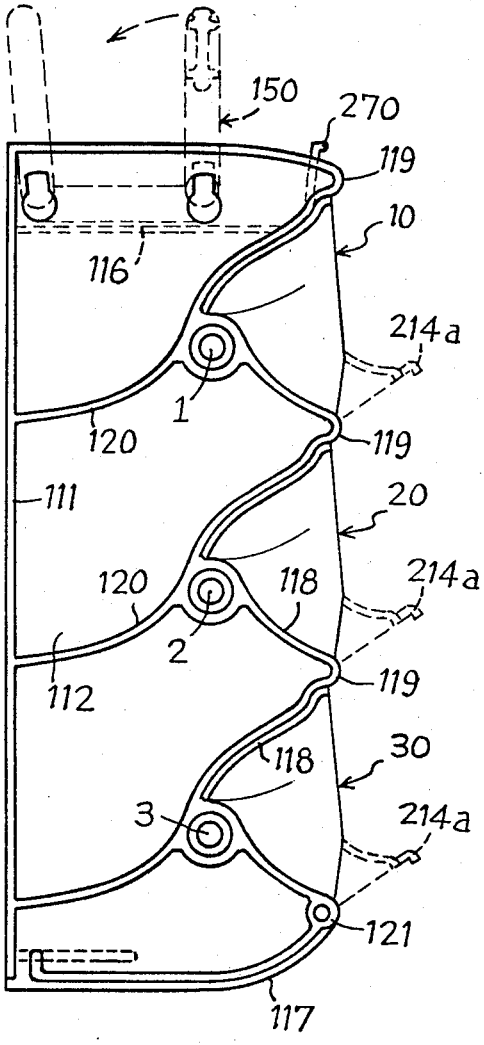
Figure 3:
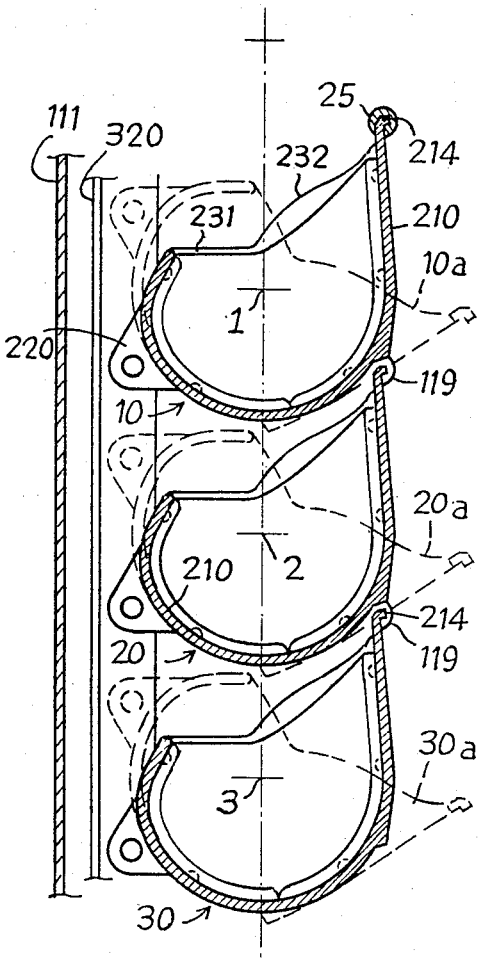
Figure 6:
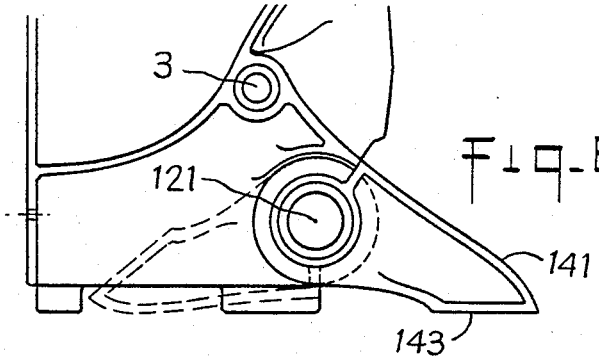
Figure 5:
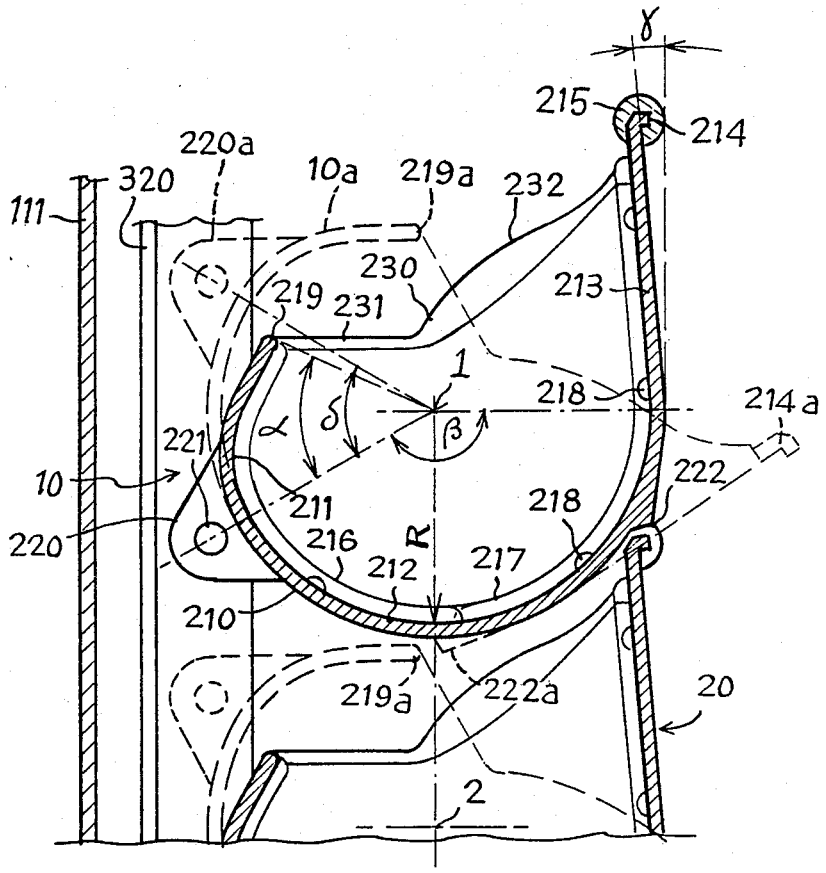
Figure 7:
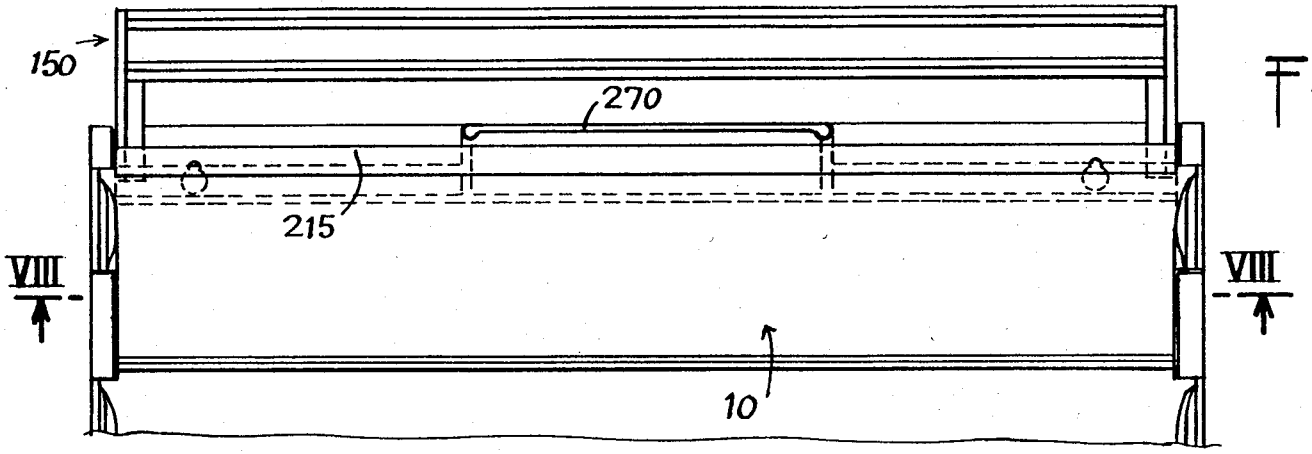
Figure 8:
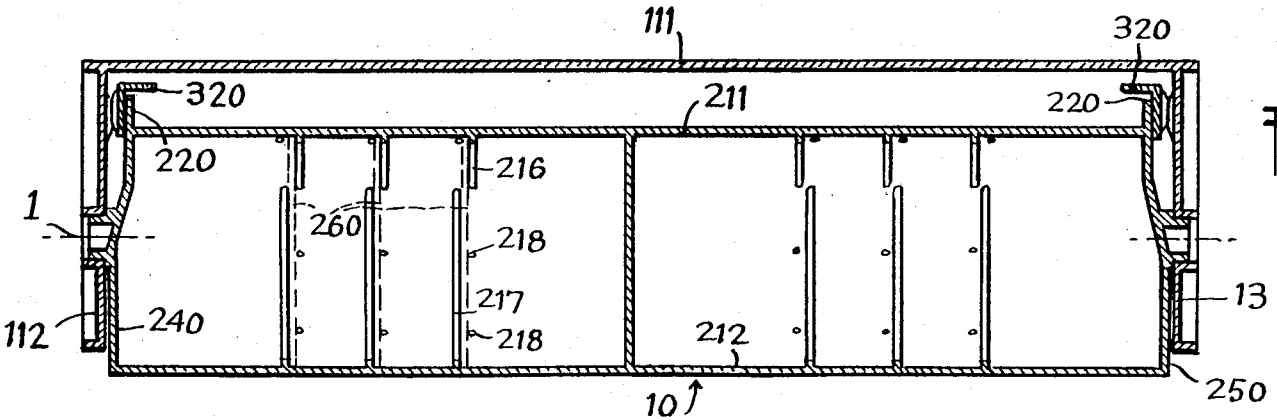
Figure 9:
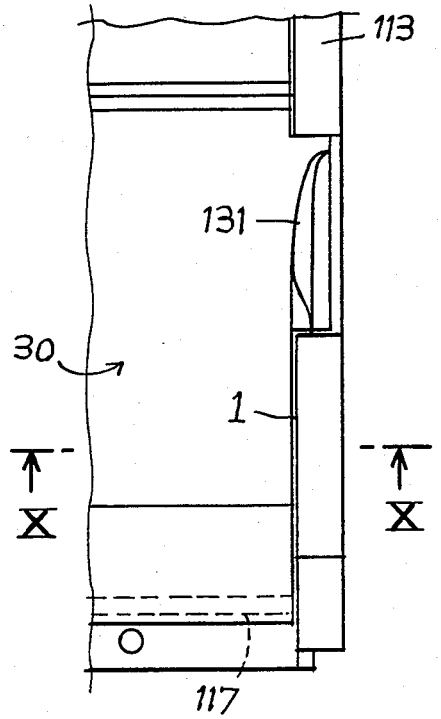
Figure 11:
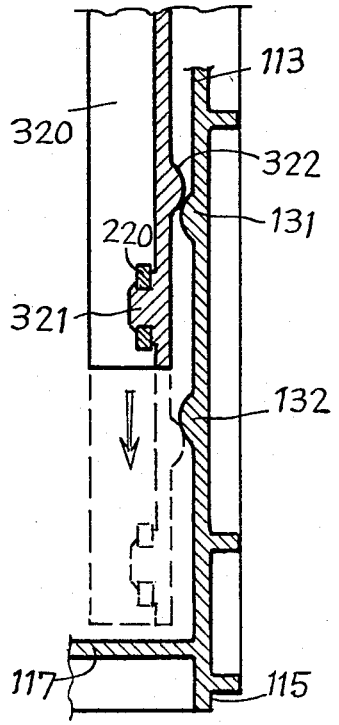
Figure 10:
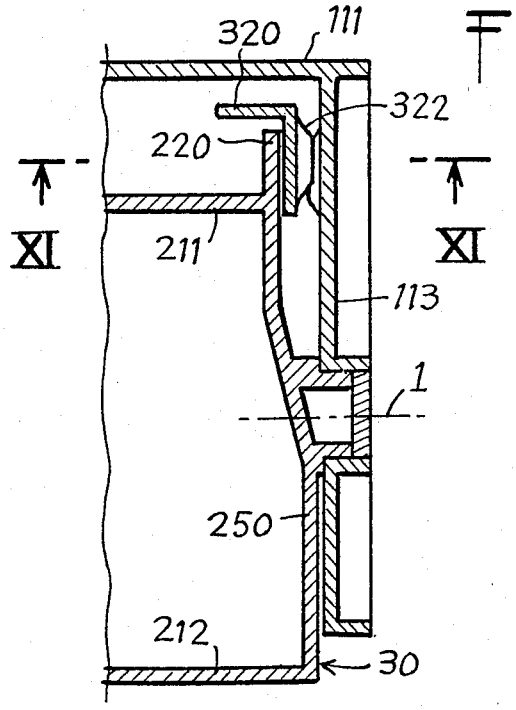
Figure 12:
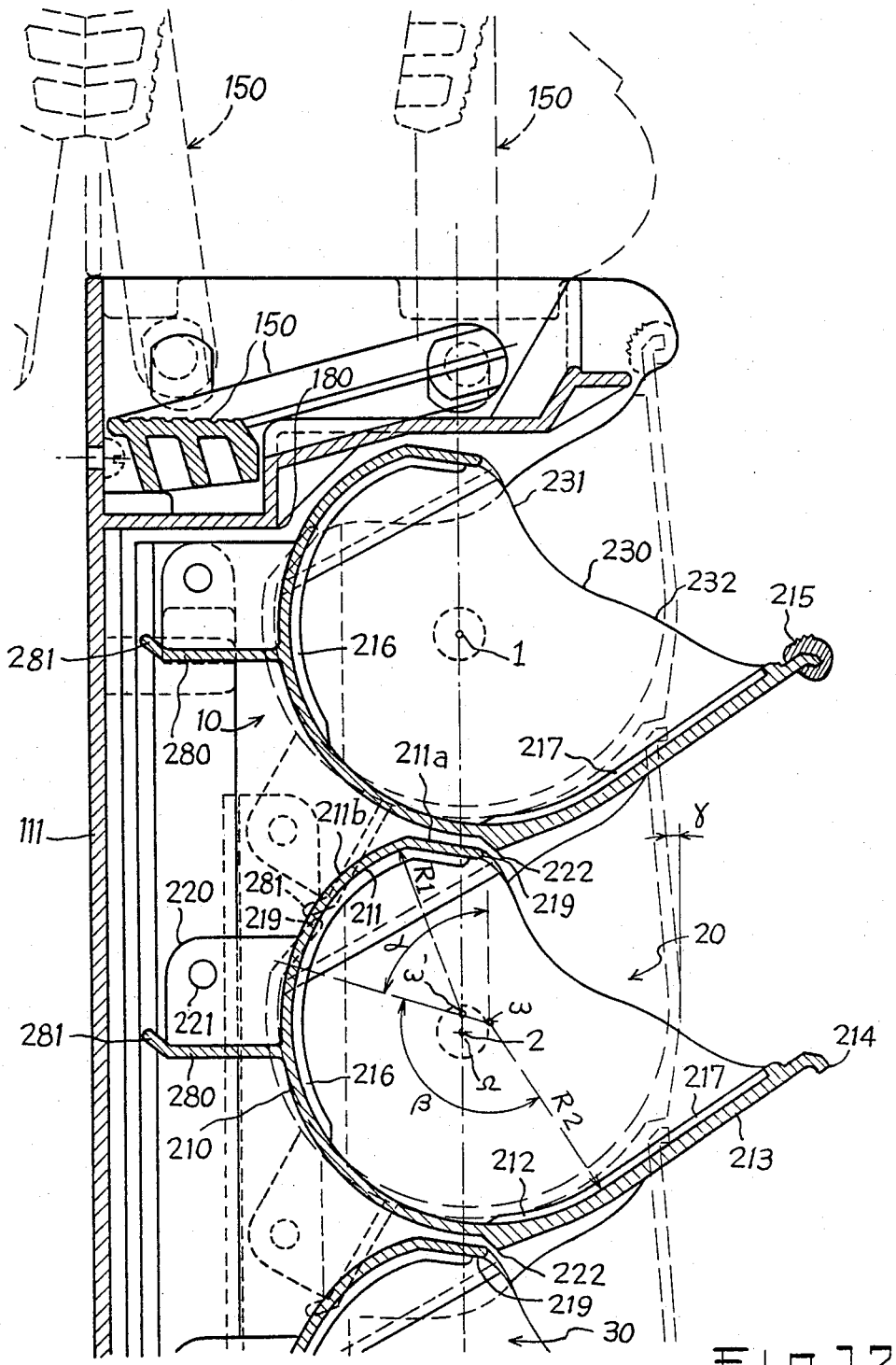

The invention will be more readily understood on reading the following description with reference to the accompanying drawings, in which:

FIG. 1 is a diagrammatical perspective of a storage cabinet according to the invention, with the different storage troughs in closed position, FIG. 2 is a similar view to FIG. 1, with the different storage troughs in open position, FIG. 3 is a cross-sectional view taken according to a vertical plane perpendicular to the axes of the troughs, and showing the superposed troughs, in closed position (block line) and in open position (broken line), FIG. 4 is a side view showing the storage troughs of FIG. 3, as mounted on the support frame, FIG. 5 is an enlarged cross-sectional view of one of the storage troughs of FIG. 3, FIG. 6 a detailed view of one possible embodiment of the feet of the cabinet according to the invention, FIG. 7 is a front view of the upper part of a cabinet according to the invention, FIG. 8 is a horizontal axial section showing a trough in closed position, FIG. 9 is a front view showing a detail of the lateral panel, FIGS. 10 and 11 are cross-sections along lines X—X and XI—XI of FIGS. 9 and 10 showing the system of bars controlling the opening of the troughs, and FIG. 12 shows a cross-sectional view of a preferred embodiment of the troughs.

Referring now to the figures, as shown in FIGS. 1 and 2, a storage cabinet 1 according to the invention comprises a support frame 110 with a back panel 111, side panels 112, 113, a base 117, a top covering panel 116 and feet members 114, 115. The support frame 110 defines a vertical unit or cabinet, adaptable either to rest on the ground or on a piece of furniture, or to be hung on a wall, or to be readily transported if fitted with a handle and/or wheels.

Rows of superposed compartments 10, 20, 30, 40 mounted in the support frame 110 define the storage spaces of the cabinet. As can be seen in FIGS. 1 and 2, the storage compartments 10, 20, 30, 40 are constituted by trough-shaped containers, pivotable about horizontal axes and mounted in a vertical plane on side faces 112, 113 of the support frame 110, in order to pass from a closed position of storage (FIG. 1) to an open position displaying the objects stored in containers 10, 20, 30, 40 (FIG. 2).

Each container or trough, which comprises a bottom 210 constituted by a straight portion of cylinder whose axis is the pivoting axis, and two lateral end walls 240, 250, can in turn be divided into a plurality of compartments, by way of vertical separations 260 parallel to the lateral end walls 240, 250. According to FIG. 2, troughs 20 and 30 are each divided into two compartments 21, 22 et 31, 32 respectively, by a separation 260, whereas trough 40 is divided into three compartments 41, 42, 43 by two intermediate separations. Several independent troughs could also be mounted in each of said superposed rows, the axes of all the troughs in one row being in alignment.

The structure of a trough is now described in details with reference to FIGS. 3, 5 and 8. The general structure of each one of the superposed troughs 10, 20, 30, 40 being the same, only the structure of trough 10 is described herein. The closed position of trough 10 is shown in the figures in block lines, and its open position 1O*a* is shown in broken lines.

The bottom 210 of a trough-shaped pivoting container 10 constitutes a portion of cylinder with, starting from the rear edge 219, a first part 211 extending over an arc of angular opening which can vary between 50° and 70°, the distance between the different points of first part 211 to axis 1 of the trough 10 gradually increasing from the free end 219. The end portion close to the free end 219 can in fact be substantially rectilinear. The bottom 210 comprises, next to the first part 211 of increasing radius, a second main part 212 which is circular and centered on axis 1, and of substantially constant radius R. Finally, said bottom 210 of a trough comprises, next to the main part 212, a third part 213 which is substantially rectilinear and joins up more or less tangentially with the main part 212. Said third part 213 joins up with the main part 212 substantially inside a horizontal axial plane when trough 10 is in closed position. Advantageously, said substantially rectilinear third part 213 is slightly inclined inwards of the trough, forming an angle $\alpha$ of between about 4° and 8° with the vertical, when the trough 10 is in closed position. The main part 212 of the bottom 210 extends preferably over an arc of circle $\beta$ of between about 140° and 160°. The back end 219 of bottom 210 is preferably situated at a distance from the axis of the trough covering 70 to 80% of radius R of the main part 212, and, in the closed position of the trough, the axial plane traversing end 219, preferably forms an angle of between 15° and 30° with the horizontal. Preferably the length of the third part 213 can vary between about 1.3 and 1.4 times that of the radius R of the circular main part 212.

With the afore described configuration, the different rows of troughs 10, 20, 30, 40 can be superposed in very compact manner, with distances between axes equal to about twice the length of radius R of the circular main parts 212 of the bottoms of troughs 10, 20, 30, 40. The reduction of the radius of the first parts 211 indeed makes allowance for the thickness of the bottom walls 210 and avoids having to limit the tilting forward movement when the troughs are open.

To open, the troughs 10, 20, 30 tilt forward by pivoting about axes 1, 2, 3 over an angle varying between 50° and 70° to reach the position 1O*a*, 20*a*, 30*a* shown in dotted line in FIG. 3. In the opening position, the end 219*a* of the first part 211 of the bottom wall 210 is virtually situated inside a vertical axial plane, whereas the third part 213 remains upwardly inclined at an angle varying between 25° and 45°, this preventing the objects stored in trough 10 from falling out.

The lateral end walls 240, 250 as well as any separations 260 provided in the troughs 10, 20, 30, 40 are terminated by an upper edge 230, which, in the trough closing position, may have a first horizontal straight part 231 extending from the free rear end 219 of the bottom wall 210 up to near the vertical axial plane of the trough, and an incurved second part 232 which may be concave or convex, and connects the rectilinear part 231 to the free end at the front of the bottom wall 210. This configuration may of course be modified in certain ways, but as described hereinabove it guarantees a fair trough-filling coefficient and easy grasping of the objects when the trough is in open position.

Moreover, in the example illustrated in FIGS. 3 and 4, part 232 is so designed as to correspond to the shape of the slots 118 in order to allow sealed closure of the troughs.

The free end 214 of front part 213 of bottom wall 210 can also be slightly bent out or it can be provided, at least over part of its length, with a stiffening rod in order to help grasping, for either closing or opening the trough. The external face of bottom wall 210 may be provided with a projection 222 permitting insertion of the free front end 214 of the bottom wall 210 of the lower trough when the troughs are in closed position.

At different parts in the bottom of the trough can be provided clipping-in means such as ribs 216, 217 or studs 218 in order to alow the fitting in of removable walls 260 in vertical planes parallel to end walls 240, 250 (FIGS. 5 and 8). Generally, the internal surface of bottom wall 210 of one trough compartment is preferably smooth and rigid. This, added to the fact that the center of gravity of the troughs hardly changes position when the troughs are opened and causes no back-balancing, contributes to preventing tilting of the objects inside the troughs when said troughs change positions.

A lug 220 is fixed on the back part of every trough, on the external face of its bottom wall 210, close to the joining area between the first part 211 and the main part 212 of bottom wall 210. As shown in greater details in FIGS. 3, 9, 10 and 11, projecting parts 321 of a vertical bar 320 are engaged into orifices 221 of the lugs 220 integral with the troughs 10, 20, 30. This contributes to ensuring a simultaneous tilting movement of said troughs. Thus it suffices to operate the end 214 of only one trough, such as for example upper trough 10, whose free front end 214 of the bottom wall is equipped with rigidifying means, in order to cause the instantaneous closing or opening of all of troughs 10, 20, 30.

The bar 320 is provided with locking means permitting to hold the troughs 10, 20, 30 in open or closed position. According to a special embodiment, bosses 131, 132 are formed on a vertical part integral with the support frame 110, for example close to a side panel 112, 113 and/or close to the bottom of support frame 110. A boss 322 is also formed on a face of bar 320 and is adapted to come in resting contact against bosses 131 or 132 when the bar 320 moves from its high position, opening troughs 1O*a*, 20*a*, 30*a*, and its lower position, closing troughs 10, 20, 30. Said bar 320 is mounted with a certain amount of play with respect to the support frame 110, both with respect to the back wall 111 of support frame 110 which is parallel to the vertical plane containing pivoting axes 1, 2, 3 of troughs 10, 20, 30 and with respect to the frame part 113 carrying permanent bosses 131, 132. The play with respect to back panel 111 is designed to allow for any deformations of the bar 320 when the lugs 220 pivot with respect to axes 1, 2, 3.

When troughs 1O*a*, 20*a*, 30*a* are in open position, the boss 322 of movable bar 320 is situated above permanent upper boss 131 which constitutes a stop means. To move to the closing position, bar 320 must be pushed down in such a way that boss 322 passes over permanent upper boss 131 and over permanent lower boss 132, both of which constitute hard points when operating the troughs. In the lower position of bar 320 (shown in dotted line in FIG. 11) which corresponds to the closing of troughs 10, 20, 30, boss 322 is held in position by permanent lower boss 132. Thus, bosses 131 and 132 constitute means of locking the troughs in the closed or open position. It is however possible to go against the locking action of said locking means, just by increasing the force exerted manually on the troughs by the operator, this making handling practical.

Two bars 320 connected to lugs 220 of the troughs 10, 20, 30, and provided with locking means 322, can be provided at the back of cabinet 1, close to side panels 112, 113 of the support frame (FIG. 8). It is of course possible to use a different number of bars 320. In like manner, the number of locking means 322, 131, 132 may be diffent from the number of troughs 10, 20, 30. In the case where opening and closing of each trough 10, 20, 30 is to be performed independently of the other troughs, it is then necessary to equip every trough with its own locking means.

The structure of the support frame 110 of the storage cabinet according to the invention can take differend forms. In FIG. 4, the pivoting axes 1, 2, 3 of troughs 10, 20, 30 are mounted in a bearing supported by a network of rods 120 defining offset parts 118 ans projecting parts 119, the projecting parts being situated on the level of the front end parts 214 of the bottoms of the troughs.

A fixed supporting bar 270 may be fixed on the upper wall 116 of the support frame 110 to facilitate opening of the troughs by means of a rigid bar 215 integral with the free end 214 of the bottom 210 of the upper trough 10. The cabinet may be equipped for exemple with a retractable and removable handle 150 (FIGS. 4 and 7). Folding back feet members 141, 143 may also be mounted at the base of cabinet 1 by means of hinges 121 fixed on side panels 112, 113 of the support frame. Foot 141 can be fitted in working position and it can either rest on a support by its lower face 143, or be retracted into the base part of the cabinet, for example when said cabinet is hung on a wall (position shown in broken lines in FIG. 6).

There is no limit to the number of rows of troughs which can be superposed. FIGS. 1 and 2, for example, show four rows of troughs whereas FIGS. 3 and 4 only show three rows of troughs. Any higher number of rows is possible. Likewise, the dimensions of the troughs 10, 20, 30 may vary in relation to the required applications. For example, for a cabinet designed for storing screws and bolts, the troughs can be of more reduced dimensions than for a cabinet designed to store, for example, tools or office supplies. In addition, the storage cabinet according to the invention is suitably produced in modular form from sets of troughs of given dimensions. Superposed rows of storage troughs may also be placed back to back or in parallelepipedal configuration. In this case, each pivoting trough may be equipped with individual means of locking it in position or, if preferred, simultaneous opening and closing of all the troughs can be caused as in the case of troughs superposed in the same plane, by means of a system of bars interconnecting all the troughs. The different panels of troughs can also retain independent systems of bar so that all the troughs on one face are open or closed simultaneously, independently of the troughs constituting the other faces of the storage complex.

The shape of the troughs which, as seen in cross-section perpendicular to the pivoting axis, resembles a spiral, can also be otherwise modified. For example, the bottom wall 210 could be constituted by a polygonal or broken line which, in average, follows substantially the continuous line shown in FIG. 5. Yet, as already indicated, it is advantageous for the inner surface of the bottom wall 210 to be smooth and without discontinuity in the direction perpendicular to the pivoting axis 1, as this prevents the objects, stored inside the troughs, from moving about and becoming mixes up when said troughs are opened or closed. Although the bottom wall 210 has been divided into three parts, for the sake of the description, in practice, there is no discontinuity between the three successive zones described and every trough can have a progressively evolutive outline.

Advantageously, the troughs are produced from plastic material, but they can also be produced from any other material showing adequate rigidity.

FIG. 12 shows a preferred embodiment of the trough which, when the trough is in closed position, defines a completely closed storage space, yet giving excellent accessibility to the objects contained in the troughs when said troughs are in open position, as well as a good visibility due to the existence of a straight non-curved end part 213.

The total closure of the troughs in the lifted position is due to tongue pieces 280 which are integral with the bottom walls of the troughs and extend outwardly substantially perpendicularly to said bottom walls. Each tongue piece 280 is situated inside a horizontal plane, when the troughs are in open position, and ensures, when said troughs are in closed position, a continuity of the bottom wall 210 of the lower adjacent trough. Said tongue pieces 280 may be slightly bent up at their back part 281 cooperating with the free rear end 219 of the bottom wall 210 of the lower adjacent trough. Thus, in the closed position of the troughs, each trough is entirely closed and the objects cannot fall out. In open position of the troughs, the back of a trough also remains closed owing to a cooperation between the free end 213 of the bottom wall of the trough and the projection 222 of the upper adjacent trough. The embodiment shown in FIG. 12 shows another trough whose center of curvature $\omega$ and center of gravity are slightly offset in the forward direction with respect to the pivoting axis $\Omega$, this facilitating opening of the filled troughs. More specifically, said first rear part 211 comprises, starting from the rear free end 219 of the bottom wall, a first portion 211*a* which is substantially rectilinear and small in length and a second curved portion 211*b* of radius $R'_1$ substantially constant with respect to a second center of curvature $\omega'$ situated above the trough pivoting center $\Omega$ inside a vertical axial plane, the radius $R'_1$ of saif second curved portion 211*b* being slightly smaller than the radius $R_2$ of the second main part 212, and the center of curvature $\omega$ being situated half way up between the second center of curvature $\omega'$ and the pivoting center $\Omega$ and slightly ahead thereof.

With this particular configuration, if the troughs are locked in their closed position, they spontaneously reach the open position by unlocking the means precedingly locking them in their closed position.

It will be further noted that the support frame is provided at its upper part with a projection 180 which is substantially parallel to the tongue pieces 280 placed in the closing position of the troughs and designed to cooperate with the bottom wall of the upper trough in order to ensure total closure of said trough when the latter is raised in closed position.

In FIG. 12, the troughs are shown in block lines when tilted forward in open position, and in broken lines when raised in closed position.

What is claimed is:

1. A storage cabinet with multiple storage compartments comprising a support frame holding a plurality of storage compartments, said storage compartments are distributed in at least two superposed rows, each of said storage compartments is adapted to pivot about parallel horizontal axes mounted in the support frame, each of said storage compartments is shaped as a trough having two lateral end walls and a bottom wall, said bottom wall is defined by a portion of cylinder and has a first rear part, a second main part, and a third front part, said third front part having a free end, said bottom wall having an external side and an internal side, each of said storage compartments is adapted to present a first closed position and a second open position, each of said storage compartments is provided with a tongue member, said tongue member is attached to said external side of said bottom wall and extends outwardly substantially perpendicular to said bottom wall, said tongue member is adapted to come into a position adjacent to the free rear end of the first rear part of the bottom wall of a lower adjacent storage compartment when said storage compartments are in said first closed position, said external side of said bottom wall is adapted to come into a position adjacent to the free end of the third front part of a lower adjacent storage compartment when said storage compartments are in said first closed position whereby each of said storage compartments is entirely closed.

2. A storage cabinet with multiple storage compartments as recited in claim 1 wherein said first rear part is of a radius progressively increasing from the free rear end of said bottom wall with respect to a first center of curvature, said second main part is of a substantially constant radius with respect to said first center of curvature, and said third front part is substantially rectilinear, said first, second and third parts are interconnected in succession without discontinuity.

3. A storage cabinet with multiple storage compartments as recited in claim 2 wherein said first rear part comprises, starting from said free rear end of said bottom wall, a first substantially rectilinear portion of small length, a second curved portion with a radius which is substantially constant with respect to a second center of curvature situated above said trough pivoting axis inside a vertical axial plane, said radius of said second curved portion is slightly smaller than the radius of said second main part, said first center of curvature is situated half-way up between said second center of curvature and said pivoting axis and is slightly ahead thereof.

4. A storage cabinet with multiple storage compartments as recited in claim 2 wherein said first rear part has an angular opening which is between about 50° and 80°, and said second main part has an angular opening which is between about 140° and 160°.

5. A storage cabinet with mulitiple storage compartments as recited in claim 3, wherein the part of said bottom wall which is of smaller radius has a minimum radius of about 75 to 85% of said radius of said second main part, whereas the length of said substantially rectilinear third front part is between about 100 and 140% of said radius of said second main part.

6. A storage cabinet with multiple storage compartments as recited in claim 2, wherein in said first closed position, the joining up zone between said third front part and said second main part is situated substantially inside a horizontal plane traversing said pivoting axis.

7. A storage cabinet with multiple storage compartments as recited in claim 6, wherein in said first closed position, said third front part is inclined inwardly of said storage compartment so as to form with the vertical an angle which can vary between 4° and 8° and is preferably around 5°.

8. A storage cabinet with multiple storage compartments as recited in claim 6, wherein in said first closed position, said free end of said first rear part of said bottom wall is situated inside a plane forming an angle of between about 25° and 35° with the horizontal plane traversing the axis containing said second center of curvature.

9. A storage cabinet with multiple storage compartments as recited in claim 1, wherein said storage compartments pivot of an angle varying between about 50° and 70°, and preferably around 60° between said open posiiton and said closed position.

10. A storage cabinet with multiple storage compartments as recited in claim 1, wherein said free end of said tongue member at the back of a storage compartment is turned up.

11. A storage cabinet with multiple storage compartments as recited in claim 1, wherein said internal side of said bottom wall of said storage compartment is rigid and smooth.

12. A storage cabinet with multiple storage compartments as recited in claim 1, wherein clipping-in means are provided on said internal side of said bottom wall of said storage compartment at desired location close to vertical planes in order to receive vertical removable partitions parallel to said lateral end walls of said storage compartment.

13. A storage cabinet with multiple storage compartments comprising a support frame holding a plurality of storage compartments, said storage compartments are distributed in at least two superposed rows, each of said storage compartments is adapted to pivot about parallel horizontal axes mounted in the support frame, each of said storage compartments is shaped as a trough having two lateral end walls and a bottom wall, said bottom wall is defined by a portion of cylinder and has a first rear part, a second main part, and third front part, said third front part having a free end, said bottom wall having an external side and an internal side, each of said storage compartments is adapted to present a first closed position and a second open position, means for simultaneously closing or opening said storage compartments, and a movable wall portion connected with each of said storage compartments, said wall portion is located outside of each upper adjacent storage compartment in the vicinity of said bottom wall, said wall portion is adapted to pivot together with said upper adjacent storage compartments around said axes when said means for simultaneously closing or opening is actuated such that said wall portion is retracted in said first closed position and adjacent to the free rear end of the first rear part of the bottom wall of a lower adjacent storage compartment when said storage compartment are in said first closed position, said external side of said bottom wall is adapted to come into a position adjacent to the free end of the third front part of a lower adjacent storage compartment when said storage compartments are in said first closed position whereby each of said storage compartments is entirely closed.

14. A storage cabinet with multiple storage compartments as recited in claim 1, wherein means are provided for locking said storage compartment in said closed position, said locking means comprising a vertical bar having at least one projecting part, at least one lug fixed on said first rear part of said bottom wall of said storage compartment, said protecting part is adapted to be engaged into said lug, said bar is provided with at least one integral first boss, said support frame is provided with at least one integral second boss situated along the path followed by said first boss, and said second boss comes into contact with said first boss when said storage compartment passes from said closes position to said open position.

* * * * *